US007926405B2

(12) United States Patent
Ducastel, Jr.

(10) Patent No.: US 7,926,405 B2
(45) Date of Patent: Apr. 19, 2011

(54) SIMULATED FIREARM

(76) Inventor: Charles J. Ducastel, Jr., Springboro, OH (US)

( * ) Notice: Subject to any disclaimer, the term of this patent is extended or adjusted under 35 U.S.C. 154(b) by 475 days.

(21) Appl. No.: 11/502,662

(22) Filed: Aug. 12, 2006

(65) Prior Publication Data

US 2008/0104873 A1 May 8, 2008

Related U.S. Application Data

(60) Provisional application No. 60/708,232, filed on Aug. 15, 2005.

(51) Int. Cl.
*F41A 21/10* (2006.01)

(52) U.S. Cl. ..... 89/29

(58) Field of Classification Search ..... 89/29; 42/177; 124/28

See application file for complete search history.

(56) References Cited

U.S. PATENT DOCUMENTS 2,356,538 A 8/1944 Schmeisser
2,882,794 A * 4/1959 Bornheim et al. ..... 89/1.4
4,088,057 A 5/1978 Nasypany
4,128,040 A 12/1978 Schuetz
4,499,811 A 2/1985 Kaste
4,590,698 A 5/1986 Finn
4,685,378 A 8/1987 Lusk
4,829,877 A 5/1989 Zerega
4,907,489 A 3/1990 Teague
5,140,893 A 8/1992 Leiter
5,180,878 A 1/1993 Denchfield
5,233,776 A 8/1993 Hessey
5,325,758 A 7/1994 Compton
5,396,844 A 3/1995 Hessey
5,438,907 A 8/1995 Reynolds
5,585,589 A 12/1996 Leiter
5,829,180 A 11/1998 Leiter
5,937,563 A 8/1999 Schuetz
6,026,728 A 2/2000 Guhring
6,266,909 B1 * 7/2001 Fuchs et al. ..... 42/75.01
6,385,887 B1 * 5/2002 Johnston ..... 42/51
6,886,467 B1 * 5/2005 Haeselich ..... 102/444

* cited by examiner

*Primary Examiner* — Stephen M Johnson
(74) *Attorney, Agent, or Firm* — Geoffrey M. Losekamp, Esq.

(57) ABSTRACT

A simulated firearm for discharging a blank cartridge and generating a realistic flash and report from the muzzle. The simulated firearm of the present invention prevents the discharge of lethal cartridges or projectiles. The simulated firearm has a chamber 65. The chamber 65 is reversed so that the entrance to the chamber 65 faces the forward section of the simulated firearm. A blank cartridge is loaded into the chamber 65. The blank cartridge is safely discharged from the reversed chamber.

12 Claims, 10 Drawing Sheets

Fig 1 a
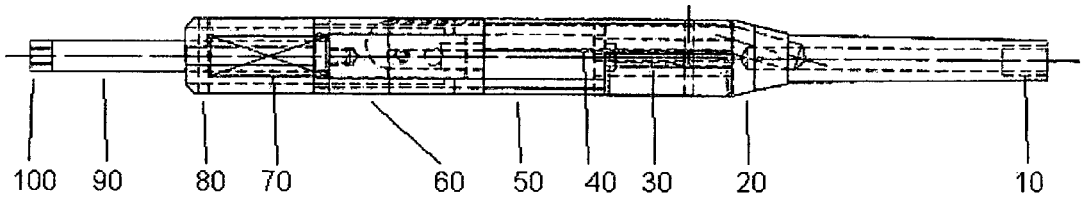
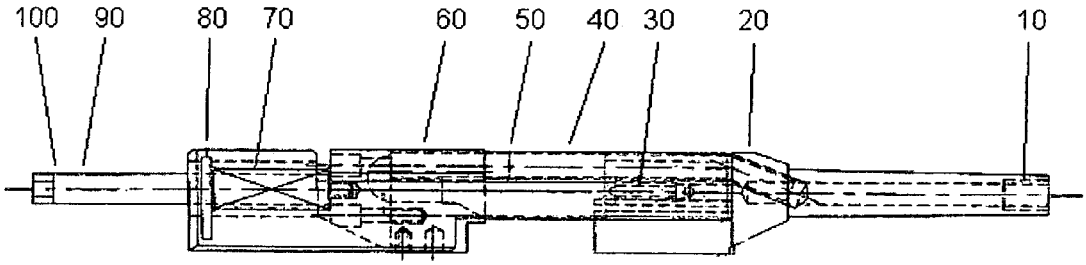
Fig 1 b

20

20

20
20
20 NOSE PIECE
SUB-ASSEMBLY
A BARREL
B NOSE PIECE

THREADS
AS SHOWN
A BARREL
B NOSE PIECE
DRILL & TAP
FLAT BOTTOM

SIMULATED FIREARM

CROSS REFERENCE TO RELATED APPLICATIONS

This application claims the benefit of provisional patent Ser. No. 60/708,232, filed 2005 Aug. 15 by the present inventor.

FEDERALLY SPONSORED RESEARCH

Not applicable.

SEQUENCE LISTING OR PROGRAM

Not applicable.

BACKGROUND OF THE INVENTION

1. Field of Invention

This application generally relates to simulated firearms, specifically to simulated firearms which use blank cartridges.

2. Prior Art

Simulated firearms are safer substitutes of actual firearms for training, educational, recreational, and theatrical purposes. Simulated firearms resemble actual firearms and produce the realistic sound and visual effects of gunfire, without discharging lethal projectiles. Automatic simulated firearms are simulated firearms which generate the effects of gunfire in a repetitive manner.

There are several types of known simulated firearms. One type disclosed by U.S. Pat. No. 5,233,776 discharges squib explosive charges along the forward section of the simulated firearm. This device can operate as an automatic simulated firearm by employing multiple squib explosive charges. One disadvantage with the squib explosive charge device is that the report and flash are not generated through the muzzle of the simulated firearm. This makes the effect of the simulated gunfire unrealistic. Another disadvantage is that blank cartridges cannot be fed through a magazine nor ejected in a realistic manner. Since squib explosive charges are not contained in a detachable magazine, this device cannot be reloaded like a conventional firearm.

Another type of known automatic simulated firearm employs blank cartridges. This device operates by loading a blank cartridge from a magazine. The blank cartridge is chambered, discharged, and ejected. However this automatic simulated firearm does not discharge gases through the muzzle like an actual firearm. Instead the chamber has gas ports which vent gases in a lateral direction to the simulated firearm. This type of gas venting satisfies legal requirements for public sale in some jurisdictions. The disadvantage with this approach is that the flash and report are not realistically generated from the muzzle.

Actual firearms can be modified to use blank cartridges without discharging lethal projectiles, but there significant problems with this practice. Unmodified actual firearms can be loaded inadvertently with lethal ammunition and cause unintended damage and serious injury. When any blank cartridge is discharged, it is possible for part of the case to shear off. The detached portion of the blank cartridge can be projected through the barrel. Such projectiles have caused serious injury and death.

A further problem with discharging blanks from actual automatic firearms is that blank cartridges typically fail to generate sufficient gas pressure and/or recoil to cycle the action. Without a projectile, the gas and recoil pressures are much lower when a blank cartridge is discharged instead of a lethal cartridge. Modifications have been developed for automatic firearms to elevate the gas pressure and recoil to allow the simulated firearm to cycle with blank ammunition. One type of adapter for gas operated automatic firearms attaches the simulated firearm muzzle, as disclosed by U.S. Pat. No. 6,026,728. Another adapter employs a barrel insert to elevate gas pressure by means of a barrel insert, as disclosed by U.S. Pat. No. 5,585,589. Both the muzzle adapter and barrel insert can be combined, as disclosed by U.S. Pat. No. 4,499,811. Another device is a barrel with a ported chamber in which the chamber ports bleed gas pressure to prevent the discharge of a lethal projectile. An example is disclosed by U.S. Pat. No. 5,937,563. With respect to recoil operated firearms, one modification elevates recoil through a barrel sleeve device, as disclosed by U.S. Pat. No. 4,907,489. Barrel insert adapters have been used for recoil operated automatic firearms, as disclosed by U.S. Pat. No. 5,585,589.

All types of blank modifications for actual firearms have inherent disadvantages. As firearms, actual firearms are subject to extensive legal restrictions governing their sale, possession, and use. External modifications detract from the realistic appearance of simulated or actual firearms firearm. In most types of adapters, the inadvertent discharge of a lethal cartridge will likely damage the adapter and firearm. Any projectile, whether from a lethal cartridge or a detached portion of a blank cartridge, may cause result in death or serious injury. Modifications can be removed, altered, or fail, thereby returning the actual firearm to its original lethal capability.

3. Objects and Advantages

Accordingly several objects and advantages of the present invention are:

(a) to realistically generate a flash and report simulating gunfire;
(b) to be incompatible with lethal cartridges;
(c) to prevent the discharge of projectiles;
(d) to be capable of loading, chambering, discharging, and ejecting blank cartridges in a safe and realistic manner;
(e) to discharge blank cartridges more reliably; and
(f) to operate in a manner not restricted by legal regulations governing the sale, use, and possession of actual firearms.

Further objects and advantages will become apparent from a consideration of the ensuing description and drawings.

SUMMARY

In accordance with the present invention, a simulated firearm capable of discharging blank cartridges, the simulated firearm having a chamber positioned with an entrance facing the forward section of the simulated firearm, the position of the chamber preventing the use lethal cartridges or the discharge of projectiles.

DRAWINGS

Figures

FIG. 1*a* is a cross-sectional view of the top of an embodiment of an automatic simulated firearm constructed in accordance with the present invention. The embodiment of the simulated firearm shown by FIG. 1*a* externally resembles the PPSh-41 submachine gun.

FIG. 1*b* is a cross-sectional view from the top of the simulated firearm of FIG. 1*a*

FIG. 2*a* is a cross-sectional view of the top of the nose piece assembly of the simulated firearm of FIG. 1*a*.

FIG. 2*b* is a cross-sectional view from the top of the nose piece sub-assembly of the simulated firearm of FIG. 1*a*.

FIG. 2*c* is a cross-sectional view of the barrel of the nose piece sub-assembly of the simulated firearm of FIG. 1*a*.

FIG. 2*d* is a cross-sectional view of the front of the barrel of the nose piece sub-assembly of the simulated firearm of FIG. 1*a*.

FIG. 2*e* is a top cross-sectional view of the nose piece of the nose piece sub-assembly of the simulated firearm of FIG. 1*a*.

FIG. 2*f* is a cross-sectional view from the top of the nose piece of the nose piece sub-assembly of the simulated firearm of FIG. 1*a*.

FIG. 2*g* is a front cross-sectional view of the nose piece of the nose piece sub-assembly of the simulated firearm of FIG. 1*a*.

FIG. 2*h* is a cross-sectional view from the front of the nose piece of the nose piece assembly of the simulated firearm of FIG. 1*a*.

FIG. 2*i* is a rear cross-sectional view of the nose piece of the nose piece sub-assembly of the simulated firearm of FIG. 1*a*.

FIG. 2*j* is a cross-sectional view from the rear of the nose piece of the nose piece sub-assembly of the simulated firearm of FIG. 1*a*.

FIG. 3*a* is right cross-sectional view of the chamber block of the simulated firearm of FIG. 1*a*.

The embodiment of the chamber block displayed by FIG. 3*a* shows a chamber block composed of two sections, a rear chamber block and a forward chamber block. Alternatively the chamber block could be composed of a single unit instead of two separate pieces.

FIG. 3*b* shows rear, side, and front cross-sectional views of the rear chamber block of the two piece chamber block embodiment shown by FIG. 3*a*.

FIG. 3*c* shows rear, side, front, and top cross-sectional views of the forward chamber block of the two piece chamber block embodiment shown by FIG. 3*a*.

FIG. 4*a* shows a top cross-sectional view of the slide of the simulated firearm of FIG. 1*a*.

FIG. 4*b* shows a right cross-sectional view of the slide of the simulated firearm of FIG. 1*a*.

FIG. 4*c* shows a bottom cross-sectional view of the slide of the simulated firearm of FIG. 1*a*.

FIG. 4*d* shows a rear cross-sectional view of the slide of the simulated firearm of FIG. 1*a*.

FIG. 4*e* shows a front cross-sectional view of the slide of the simulated firearm of FIG. 1*a*.

FIG. 4*f* shows enlarged cross-sectional views of the slide of the simulated firearm of FIG. 1*a*.

FIG. 5*a* shows a top cross-sectional view of the gas tube of the simulated firearm of FIG. 1*a*.

FIG. 5*b* shows a right cross-sectional view of the gas tube of the simulated firearm of FIG. 1*a*.

FIG. 6*a* shows forward and side views of the firing pin of the simulated firearm of FIG. 1*a*.

FIG. 6*b* shows forward and side views of the spring stop of the simulated firearm of FIG. 1*a*.

Figure 8:
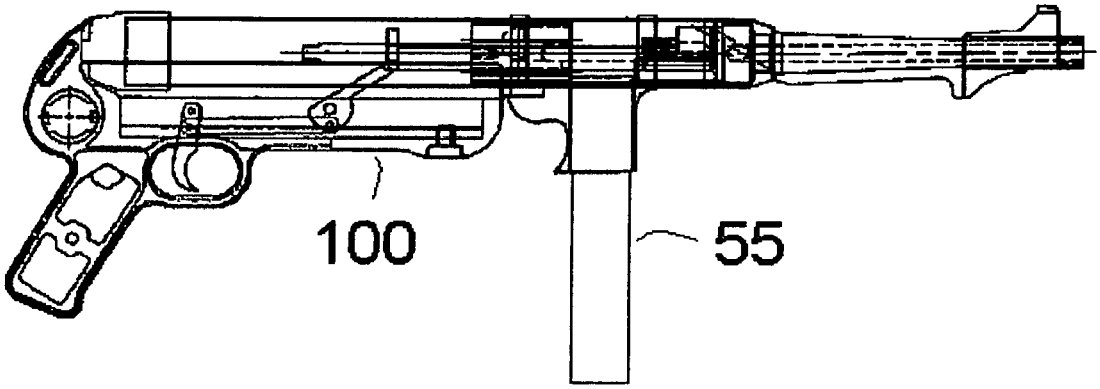
FIG. 8 shows a right cross-sectional view of an automatic simulated firearm of the present invention in an embodiment externally resembling the MP-40 submachine gun.
Figure 9A:
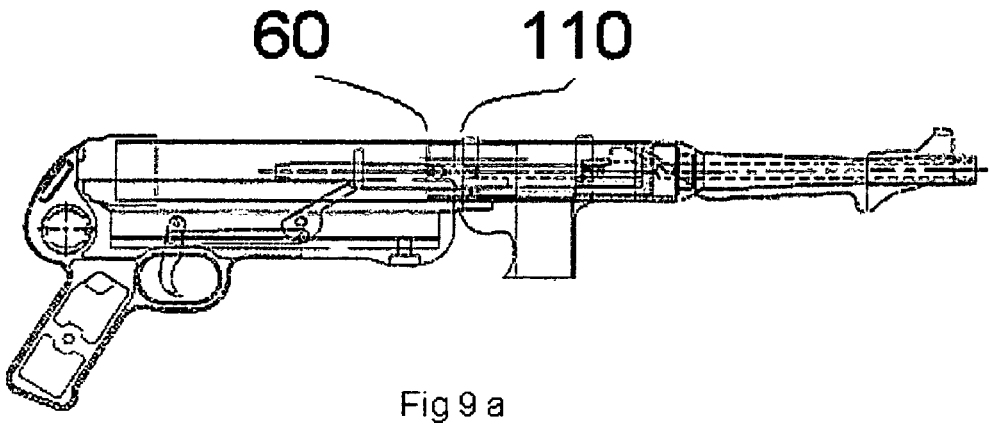

FIG. 9*a* shows a right cross-sectional view of an alternate embodiment of the simulated firearm shown by FIG. 8 in which exhaust gases are vented from the top of the simulated firearm body.

Figure 9B:
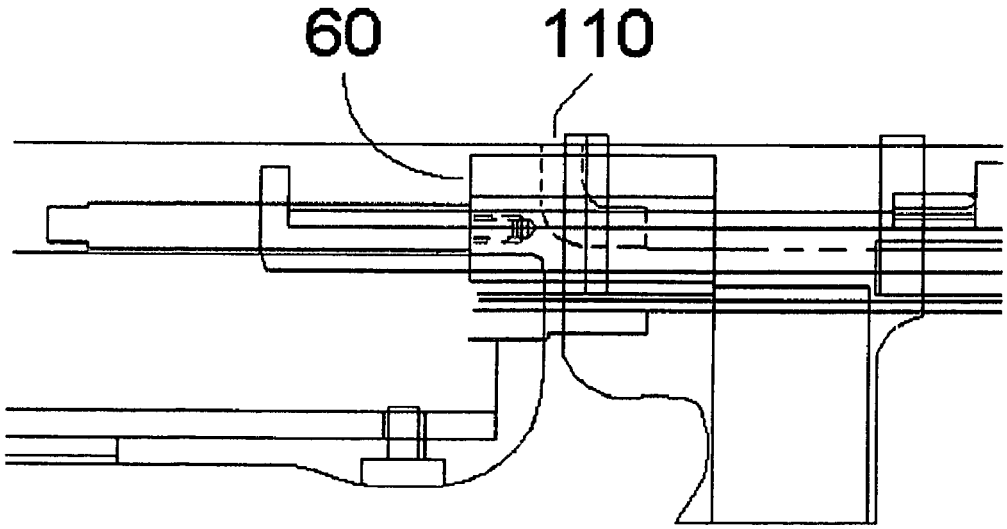

FIG. 9*b* shows enlarged cross-sectional view of the slide, chamber block, and exhaust vent of the simulated firearm of FIG. 9*a*.

DETAILED DESCRIPTION

FIGS. 1-9

Operation—FIGS. 1-9

FIG. 1*a* and FIG. 1*b* show cross-sectional views of an embodiment of an automatic simulated firearm constructed in accordance with the present invention. The embodiment of the body 100 shown by FIGS. 1*a* and 1*b* externally resembles the PPSh-41 submachine gun. A set screw 10 of the simulated firearm is threadably attached to the barrel portion of the nose piece assembly 20. The nose piece sub-assembly 20 is attached to the body 100. The gas tube 40 extends from the nose piece sub-assembly 20 to the chamber block 60. A cavity extends from the U-shaped cavity of the chamber block 60 through gas tube 40 and to the cavity of the nose piece sub-assembly 20. The slide 50 is slidably attached to the body 100, and travels between the nose piece sub-assembly 20 and the chamber block 60. The slide 50 houses the firing pin 30. The forward section of the spring guide 90 is circumferentially mounted by the operating spring 70. The operating spring 70 is limited in its rearward travel by the spring stop 80. In the disclosed embodiment the body 100 appears like a Soviet PPSH-41 submachine gun. Alternatively the body could externally resemble other firearms, including but not limited to the MP40 submachine gun, the Kalashnikov rifle and variants, or other firearms as desired. The body includes conventional firearm components such as a trigger assembly, sear, hammer, and cartridge feeding device. These conventional firearm components are not shown in FIG. 1.

Figures 2A, 2B, 2C, 2D, 2E, 2F, 2G, 2H, 2I, 2J:
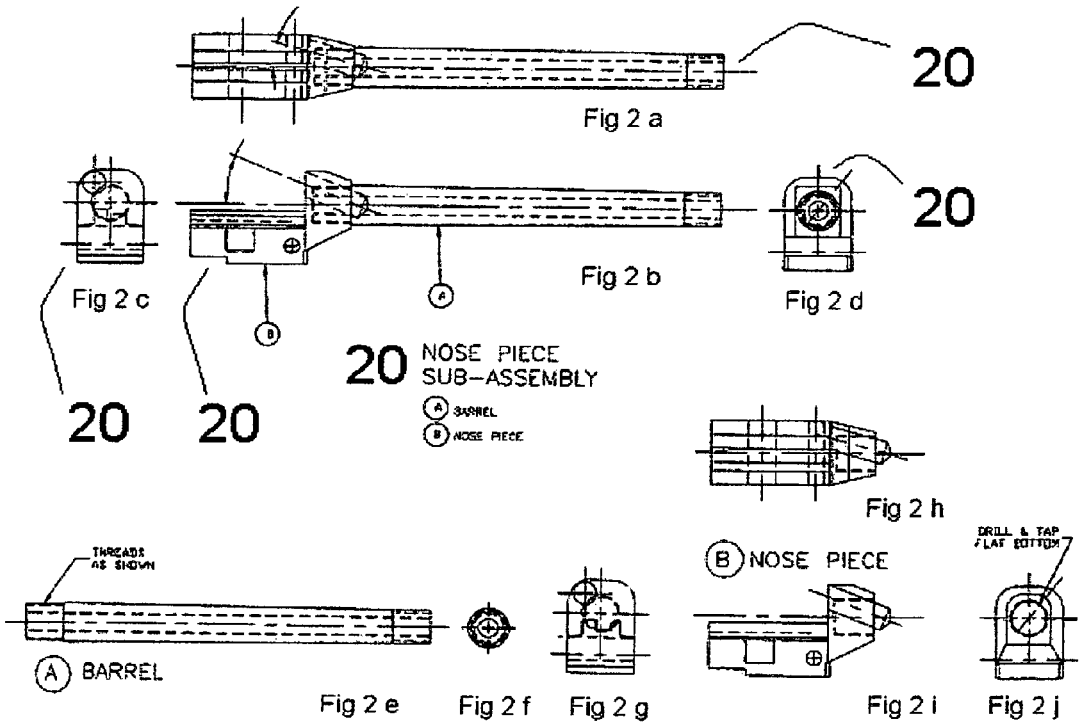

FIG. 2 shows the nose piece sub-assembly 20 of the simulated firearm of the present invention. FIG. 2*a* and FIG. 2*b* show cross-sectional views from the top of the nose piece sub-assembly 20. FIG. 2*c* and FIG. 2*d* show side and front views of the nose piece sub-assembly 20. FIG. 2*e* and FIG. 2*f* show side and top cross-sectional components of the nose piece of the nose piece sub-assembly 20. In the displayed embodiment, the barrel is threadably attached to the nose piece sub-assembly 20. Other embodiments could attach the barrel to the nose piece sub-assembly 20 by alternative means. FIG. 2*g*, FIG. 2*h*, FIG. 2*i*, and FIG. 2*j* show rear and front cross-sectional views of a nose-piece component of the nose piece sub-assembly 20.

Figure 3A:
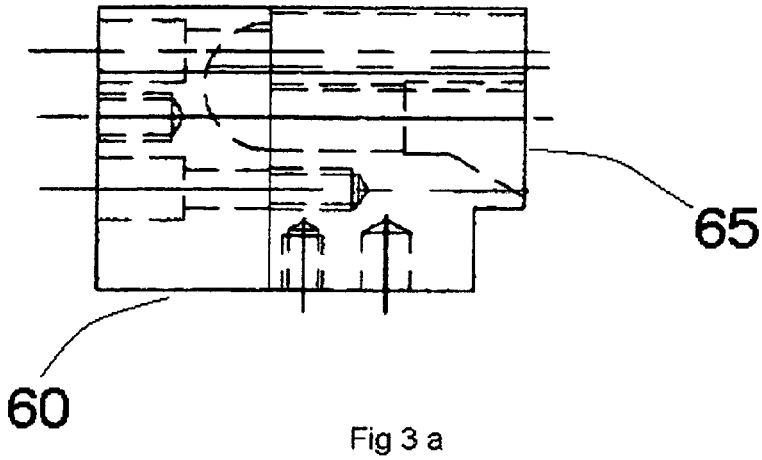
Figure 3B:
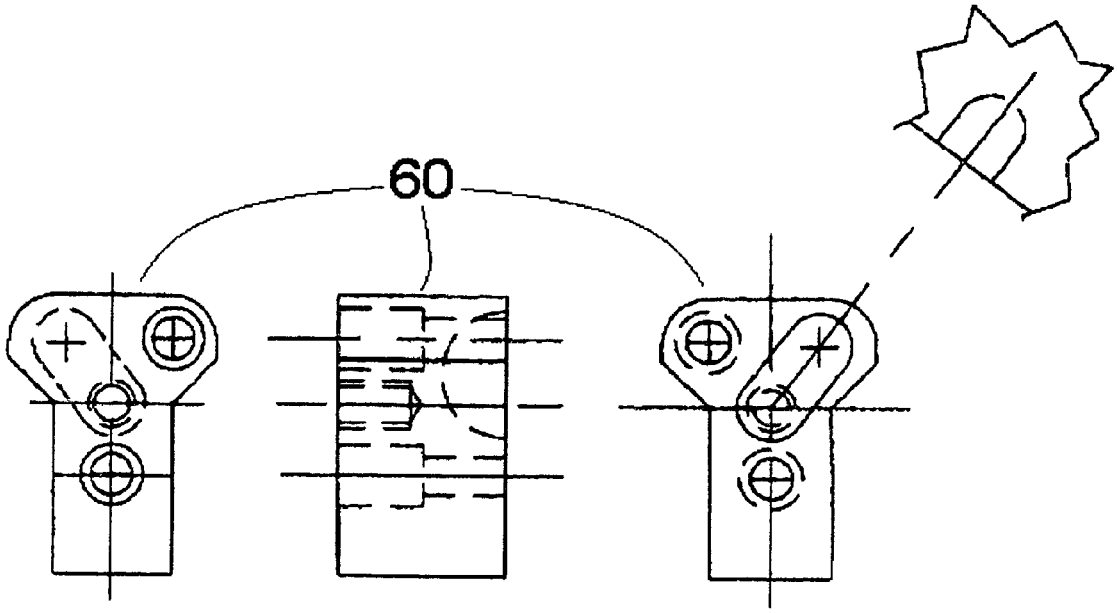
Figure 3C:
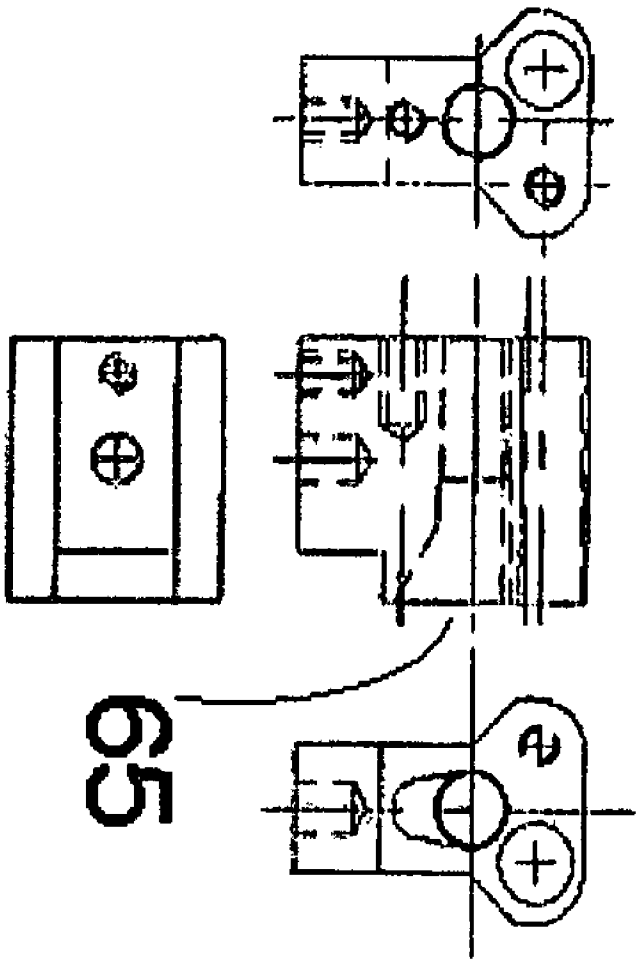
Figure 4A:
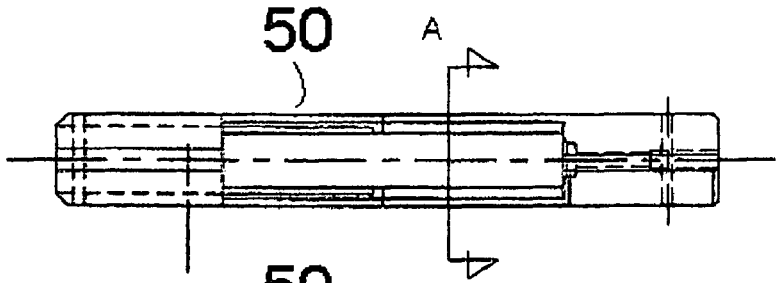
Figure 4B:
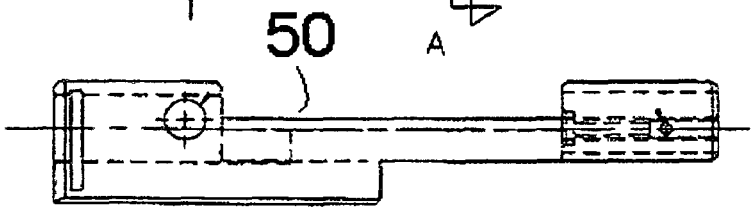
Figure 4C:
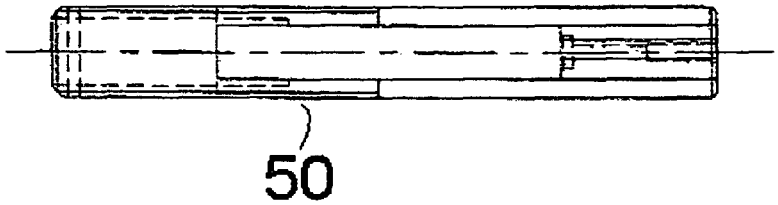
Figure 4D:
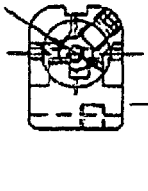
Figure 4E:
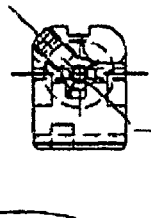
Figure 4F:
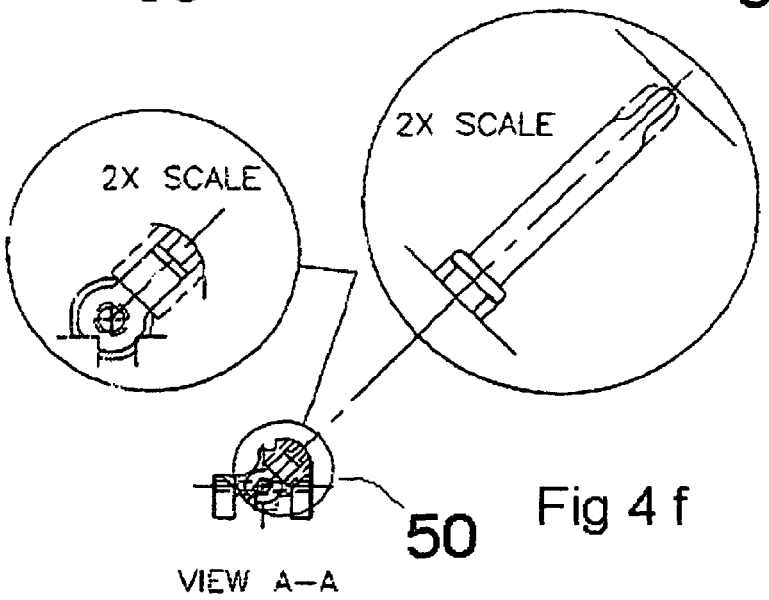

FIG. 3*a* shows a cross-sectional view of the chamber block 60, with a U-shaped cavity extending from a chamber 65 to the gas tube 40. When the simulated firearm is discharged, gases are ported from the chamber 65 through the U-shaped cavity to the gas tube 40. In the embodiment disclosed by FIG. 3*a*, the chamber block 60 is composed of front and rear sections. Alternatively the chamber block 60 could be composed of a single piece. FIG. 3*b* shows cross-sectional views of the rear chamber block component of the embodiment disclosed by FIG. 3*a*. FIG. 3*c* shows cross-sectional views of the front chamber block of the embodiment disclosed by FIG. 3*a*. FIG. 4*a* through FIG. 4*c* show cross-sectional views of the slide 50. FIG. 4*d* and FIG. 4*e* show front and rear cross-sectional views of the slide 50. FIG. 4*f* shows an enlarged cross-sectional display of slide 50. When moved in a forward direction, the slide 50 engages on the sear (not shown).

Figure 5A:
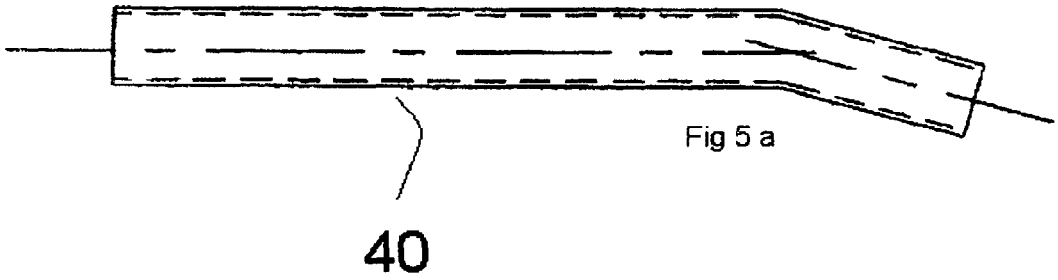
Figure 5B:
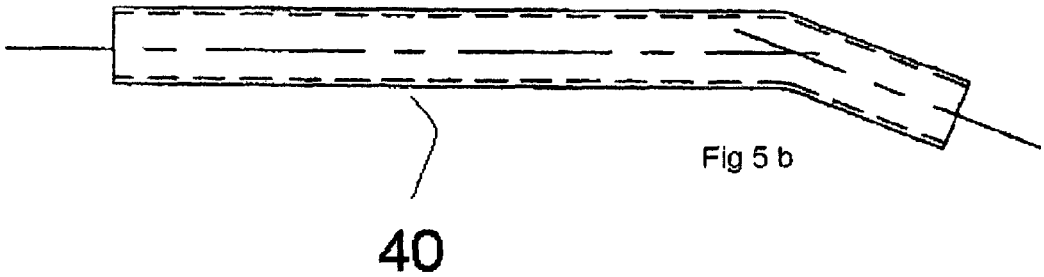

FIG. 5*a* shows a top cross-sectional view of the gas tube 40. The cavity enclosed by the gas tube 40 extends from the U-shaped cavity of the chamber block 60 to the nose piece sub-assembly 20. Upon discharge of a blank cartridge, exhaust gases are ported from the chamber block 60 through the gas tube 40 to the nose piece sub-assembly 20. FIG. 5*b* shows a right lateral cross-sectional view of the gas tube 40.

Figure 6A:
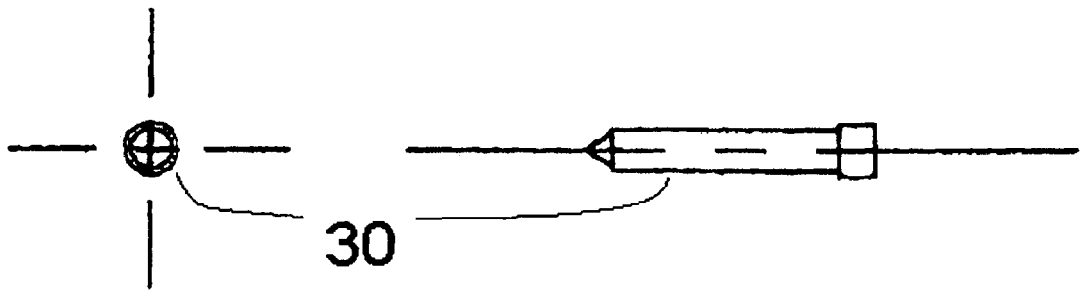
Figure 6B:
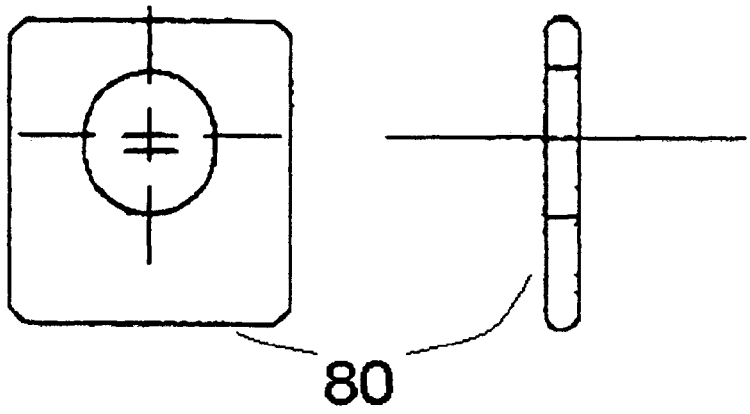

FIG. 6*a* shows front and side views of the firing pin 30. The firing pin is housed within the slide 50. FIG. 6*b* shows front and side views of the spring stop 80. The spring stop 80 restricts the travel of the operating spring 70 along the spring guide 90.

Figure 7:
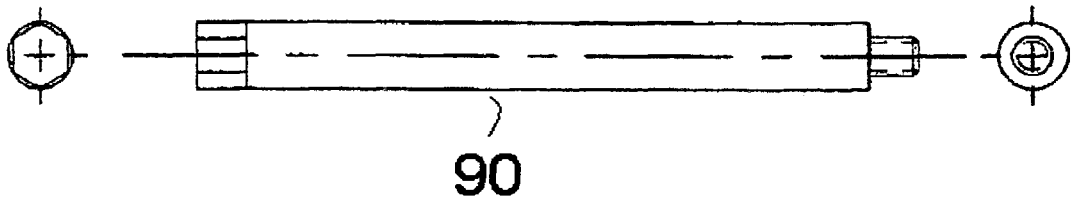
FIG. 7 shows rear, side, and forward views of the spring guide of the simulated firearm of FIG. 1*a*.

FIG. 7 shows a rear, side, and front views of the spring guide 90. The spring guide 90 is housed within the body 100. The operating spring 70 extends circumferentially around the spring guide 90.

FIG.8 shows a lateral cross-sectional view of an alternative embodiment of an automatic simulated firearm constructed in accordance with the present invention. The body 100 of the simulated firearm shown by FIG. 8 externally resembles the MP-40submachine gun.

FIG. 9*a* shows a lateral cross-sectional view of an alternative embodiment of the simulated firearm shown by FIG. 8. A cavity extends from the U-shaped cavity of the chamber block 60 to the exhaust vent 110. FIG. 9*b* shows an exploded cross-sectional view of the chamber block 60 and the exhaust vent 110.

DRAWINGS

Reference Numerals

10) set screw
20) nose-piece assembly
30) firing pin
40) gas tube
50) slide
55) blank feed device
60) chamber block
70) operating spring
80) spring stop
90) spring guide
100) body
110) exhaust vent Operation The simulated firearm of the present invention operates as follows. A blank cartridge is inserted into the chamber 65 of the simulated firearm. The entrance to the chamber 65 faces the forward section of the simulated firearm. The simulated firearm is discharged when the trigger is pulled. The trigger moves the sear which releases the firing pin 30. The firing pin 30 strikes the primer of the blank cartridge, causing it to detonate.

In one embodiment of the simulated firearm, the gasses from the blank are ported through the U-shaped cavity of the chamber block 60 and enter the gas tube 40. The gases vent through gas tube 40 to the nose piece sub-assembly 20 and exit the simulated firearm. In an alternate embodiment of the present invention, gases could be ported through gas tube 40 to the external vent 110. The gases could also be ported from directly from the chamber block 60 to the external vent 110.

The automatic embodiment of the simulated firearm of the present invention operates in the following manner. The slide 50 is pushed in a forward direction over a sear. The sear retains the slide 50 in a forward position, creating a cavity between the slide 50 and the chamber 65. A blank feed device 55 containing blank cartridges is engaged into the body of the simulated firearm between the slide 50 and the chamber 65 of the chamber block 60. The blank feed device 55 holds the blank cartridges so that the crimped portion of the blank cartridge faces the rear of the simulated firearm, and the primed portion of the cartridge faces the muzzle of the simulated firearm.

When the blank feeding device is engaged and the trigger is pulled, the sear releases the slide 50. The operating spring 70 propels the slide 50 in a rearward direction towards the chamber block 60. In its rearward travel the slide 50 strips a blank cartridge from the blank feeding device and forces it into the chamber 65.

The simulated firearm is discharged when the trigger is pulled. The trigger moves the sear which releases the slide 50 that carries the firing pin 30. The slide 50 moves rearward causing the firing pin 30 to engage the blank cartridge. The trigger releases a hammer which impacts the firing pin 30. The firing pin 30 strikes the primer of the blank cartridge, causing it to detonate. The gasses from the blank are ported through the U-shaped cavity of the chamber block 60 and enter the gas tube 40. The gases vent through gas tube 40 to the nose piece sub-assembly 20 and exit the simulated firearm.

In an alternate embodiment of the simulated firearm of the present invention, gases may be vented through gas tube 40 to the external vent 110 and exit the simulated firearm. The gases could instead be vented directly from the chamber block 60.

The gas pressure in the system is elevated due to the detonation of the blank cartridge. Elevated gas pressure forces the slide 50 to travel in a forward direction. As the slide 50 travels forward, it extracts the discharged blank cartridge from the chamber 65. The slide 50 retains the blank cartridge until it passes the edge of the nose piece sub-assembly 20. When the blank passes over the lead edge of the nose-piece, the blank is stripped from the slide 50 and is pushed away from the mechanism. Alternatively, the slide would pass over a stripping device which would cause the blank to be pushed off of the face of the slide. In this instance the nose piece could be a holding device for the barrel and the gas tube run directly into the barrel. The slide 50 continues its forward travel and returns to the "open" or forward position.

As long as the sear is not in a position to catch the slide 50, and blank cartridges remain in the feeding device, the slide 50 continues to repeat the above operation. When the sear is returned to its original position, it engages the slide 50 and halts the operation of the simulated firearm.

I claim:

1. A simulated firearm for safely discharging a blank cartridge, comprising:

a. a body, b. a chamber block, c. a chamber within said chamber block for containing a blank cartridge, the entrance to said chamber facing the muzzle of said simulated firearm, and d. a U-shaped cavity within said chamber block connecting said chamber and adapted to port exhaust gases from said chamber through said chamber block.

2. The simulated firearm of claim 1 wherein the simulated firearm additionally comprises:

a. a slide for extracting a blank cartridge from said chamber, and b. a nose piece with a leading edge, wherein said leading edge of said nose piece strips said blank cartridge from said slide.

3. The simulated firearm of claim 2 wherein the simulated firearm additionally comprises a gas tube connecting said chamber block cavity to said nose piece.

4. The simulated firearm of claim 1 wherein the simulated firearm has a blank cartridge feed device.

5. The simulated firearm of claim 1. wherein the simulated firearm has a vent connecting said chamber block cavity to the exterior of said body.

6. A method of safely discharging a blank cartridge from a simulated firearm, comprising:

a. providing a body, b. providing a chamber block, c. providing a chamber within said chamber block for containing a blank cartridge, the entrance to said chamber facing the muzzle of said simulated firearm, e. providing a U-shaped cavity within said chamber block connecting said chamber and adapted for porting exhaust gases from said chamber through said chamber block cavity, and f. discharging said blank cartridge.

7. The method of claim 6 wherein said blank cartridge is ejected from the simulated firearm.

8. The method of claim 6 wherein the simulated firearm is provided means for redirecting exhaust gas from the chamber.

9. The method of claim 6 wherein the simulated firearm is additionally provided:

a. a slide for extracting a blank cartridge from said chamber, and b. a nose piece with a leading edge, wherein said leading edge of said nose piece strips said blank cartridge from said slide.

10. The method of claim 9 wherein the simulated firearm is additionally provided a gas tube connecting said chamber block cavity to said nose piece.

11. The method of claim 6 wherein the simulated firearm is provided a blank cartridge feed device.

12. The method of claim 6 wherein the simulated firearm is provided a vent connecting said chamber block cavity to the exterior of said body.

* * * * *